United States Patent [19]

Irwin

[11] Patent Number: 4,632,138

[45] Date of Patent: Dec. 30, 1986

[54] PORTABLE SHELTER

[76] Inventor: Dennis V. Irwin, 4630 Macky Way, Boulder, Colo. 80303

[21] Appl. No.: 746,724

[22] Filed: Jun. 20, 1985

Related U.S. Application Data

[63] Continuation-in-part of Ser. No. 472,029, Mar. 4, 1983, Pat. No. 4,554,937.

[51] Int. Cl.[4] ..... E04H 15/48

[52] U.S. Cl. ..... 135/109

[58] Field of Search ..... 47/26–29, 47/31; 135/87, 93, 97, 99, 100, 102, 106, 109–112, 115, 117, 119, DIG. 9, 901, 902; 272/56.5

[56] References Cited

U.S. PATENT DOCUMENTS

| | | | |
|---|---|---|---|
| 1,238,142 | 8/1917 | Hitchcock | 47/26 X |
| 1,392,178 | 9/1921 | Kuebler | 47/29 |
| 1,713,439 | 5/1929 | Klyaich | 135/902 |
| 1,728,356 | 9/1929 | Morgan | 135/97 |
| 2,159,273 | 5/1939 | Killinger | 135/901 |
| 2,755,009 | 7/1956 | Parker | 135/100 |
| 2,808,844 | 10/1957 | Powers | 135/99 |
| 2,818,875 | 1/1958 | Denn | 135/100 |
| 2,967,534 | 1/1961 | Silye | 135/901 |
| 3,105,505 | 10/1963 | Maybee | 135/901 |
| 3,503,101 | 3/1970 | Kolozsvary | 135/119 |
| 3,537,668 | 11/1970 | Stein | 135/902 |
| 3,550,601 | 12/1970 | Peters | 135/102 |
| 3,709,237 | 1/1973 | Smith | 135/87 |
| 3,810,482 | 5/1974 | Beavers | 135/DIG. 9 |
| 3,913,598 | 10/1975 | Glutting et al. | 135/87 |
| 4,026,312 | 5/1977 | Beavers | 135/DIG. 9 |
| 4,067,346 | 1/1978 | Husted | 135/106 |
| 4,077,417 | 3/1978 | Beavers | 135/106 |

FOREIGN PATENT DOCUMENTS

| | | | |
|---|---|---|---|
| 3824 | of 1927 | Australia | 135/112 |
| 257318 | 10/1948 | Switzerland | 47/28 |
| 889455 | 2/1962 | United Kingdom | 135/112 |

*Primary Examiner*—James R. Feyrer

*Attorney, Agent, or Firm*—James E. Pittenger

[57] ABSTRACT

A portable, free-standing shelter for hunters and the like which is of generally frusto-conical configuration and has a base and upwardly inclined side panels terminating in an open top. The sidewalls are defined by a plurality of panels of generally trapezoidal configuration, having top and bottom edges connected by upwardly convergent opposite sides. Hinge means interconnect adjacent sides of the panels in articulated pivoting relation so that the side panels can be folded back over each other. The connected side panels may be arranged into various configurations. The top of the shelter can be closed with a suitable cover which is supported by a number of flexible rods or poles which are mounted diagonally across the top opening and have sufficient length to be bowed in an upward direction to suitably support the covering in a curved configuration. The side panels of the shelter also can be held in an extended stretched condition by a pair of flexible rods which are diagonally mounted across the corners of the side panel to hold it rigid. The flexible support rods can be arranged in telescoping sections with the entire shelter easily folded and carried as a small compact package.

12 Claims, 16 Drawing Figures

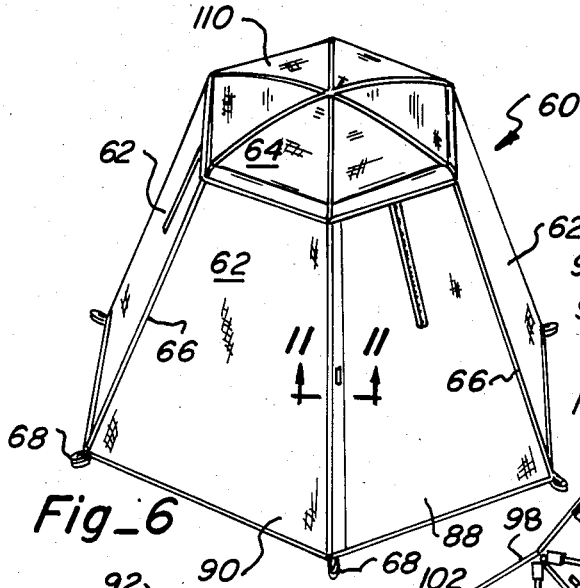
Fig_6
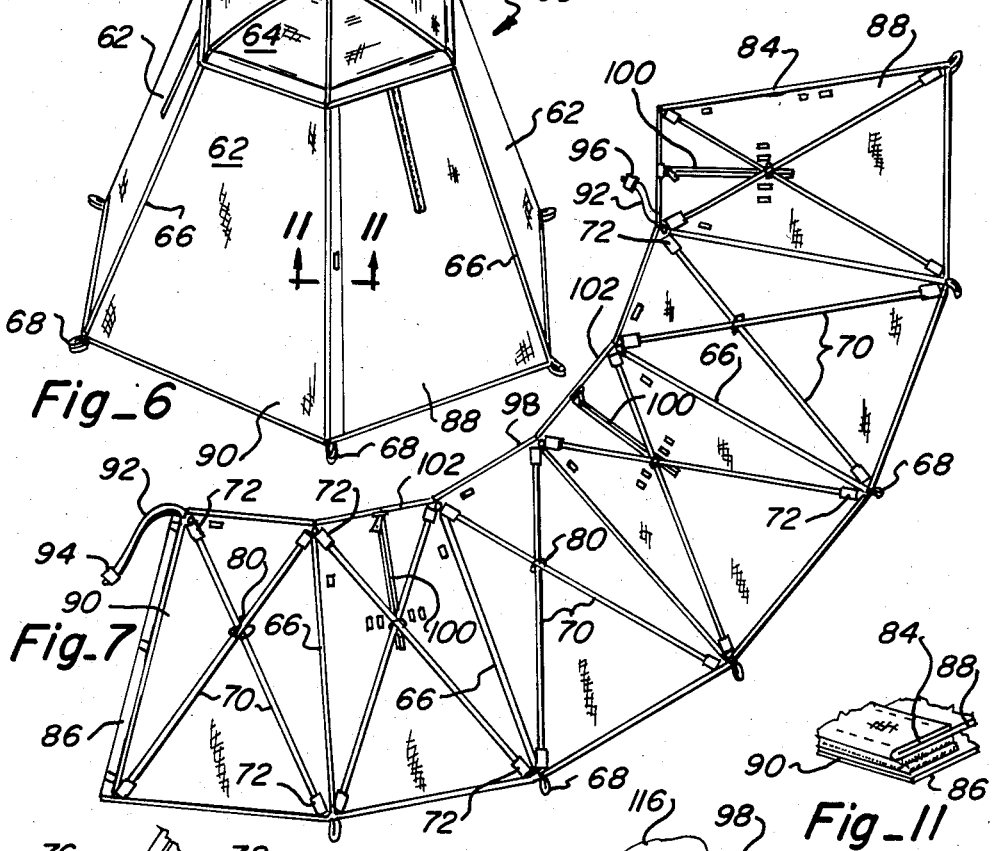
Fig_7
Fig_11
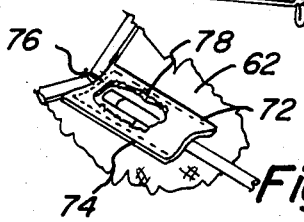
Fig_9
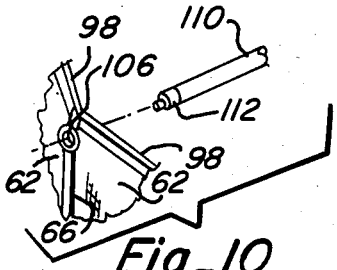
Fig_10
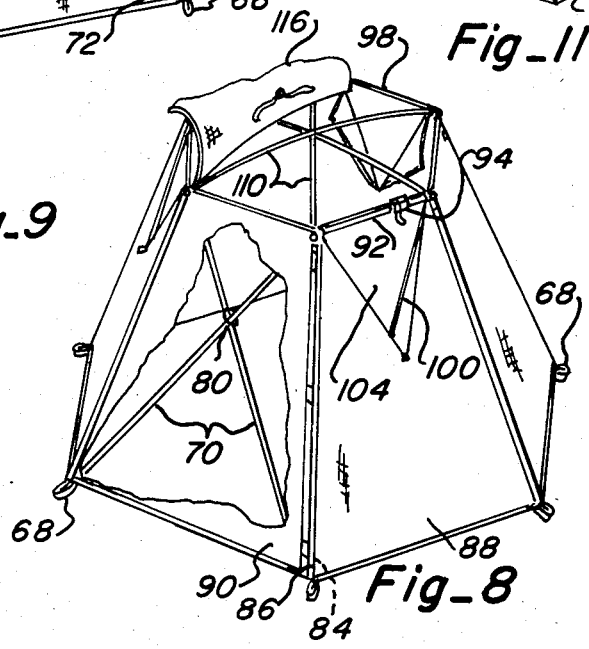
Fig_8

PORTABLE SHELTER

This application is a continuation-in-part of my copending application Ser. No. 472,029 filed Mar. 4, 1983, now U.S. Pat. No. 4,554,737.

FIELD OF THE INVENTION

This invention generally relates to portable shelters, and more particularly relates to a novel and improved collapsible portable shelter which is particularly suitable for, but not limited to, use by hunters and other outdoorsmen as a blind or concealing screen and by utility workers as a shelter or safety cover.

BACKGROUND OF THE INVENTION

Hunters, birdwatchers or wildlife photographers pursuing certain types of game, such as, waterfowl often experience greater success by setting up a temporary "camp" and waiting for the animal to approach within range than by actively stalking their quarry. In practicing the former technique, the outdoorsman first selects a spot that is likely to be frequented by the animal, then conceals his presence there by some means, and finally settles down to wait, perhaps for hours, for the arrival of his quarry. In the past, the choice of a likely spot has been subject to the availability of natural shelter, such as, a thicket to serve as a screen. Unfortunately, such means of concealment are not always available at an otherwise favorable site. Moreover, bushes and the like do not afford much protection from the elements, and therefore are likely to become an uncomfortable shelter after any length of time.

Alternatively, the outdoorsman may resort to using an artificial shelter of the type known commonly as a "duck blind" which comprises a low, shack-like structure constructed of plywood or similar material provided with a burlap screen or small windows for observation of the hunting site. Such blinds serve as permanent shelters and are most often built along the shores of frequently hunted lakes and reservoirs and are therefore unsuitable for the outdoorsman who wishes to avoid the more popular areas, or who prefers to move from site to site in search of the most favorable location for his purposes. To date, there remains a need for a temporary shelter or blind which is capable of being constructed and taken down quickly, and may be moved easily to different locations while still fully assembled, or with only minimal effort to disassemble. Moreover, it is particularly desirable that such structure be adaptable for a variety of other uses, for example, as a windbreak or emergency tent, or as a storage structure for firewood, food, or other supplies. The portable shelter of the present invention is believed to offer these as well as other advantages which will be particularly valuable to hunters, fishermen, photographers, or anyone requiring a temporary shelter or camouflage device for any purpose.

INFORMATION DISCLOSURE STATEMENT

The following patents which are believed to be pertinent to the subject matter of this invention are presented in compliance with the inventor's duty to disclose all materials of which he is aware and which might effect the examination of this application.

The Parker patent (U.S. Pat. No. 2,755,009) is directed to a painter's drop cloth which has a supporting rod in each corner of the device. The rod is arranged to hold the drop cloth in an extended position and each rod extends through a tubular section at the corner of the cloth.

The Kuebler patent (U.S. Pat. No. 1,392,178) is a collapsible and ventilating cover for growing plants. This device has trapezoidal side panels with the side panels hinged together to form a continuous structure.

The O'Brian patent (U.S Pat. No. 4,159,112) also shows a trapezoidal side panel structure having the side panels hinged together to each other to form a collapsible structure. The side panels have openings which allow a child to climb and play on the structure.

The Silye patent (U.S. Pat. No. 2,967,534) merely shows a tent type collapsible structure. The framework is composed of a number of telescoping rods which support a roof frame. The framework is covered on the outside by a suitable canvas material.

The Glutting, et al. patent (U.S. 3,913,598) shows a hunter's blind and shelter which has a number of foldable wire frames which are used to support and suspend an outer covering. The frame sections in this patent are rectangular and are supported by angled braces which produce a rigid structure. Releasable fastenings hold the outer cover to the framework. Neither this patent or the other patents cited above show the novel cross braced shelter panel sections which are a novel feature of the applicant's invention.

SUMMARY OF THE INVENTION

It is therefore an object of the present invention to provide for a novel and improved free-standing portable shelter or blind particularly suitable for use by hunters and other outdoorsmen as a means of concealment or as a windbreak, and additionally as a tent or storage structure.

Another object of the present invention is to provide for a novel and improved portable shelter or blind which is adapted for rapid assembly into a free-standing, closed structure either with or without a cover or roof portion, or alternatively into an open, generally linear configuration so as to form a screen, or into a partially closed arrangement provided with a door or accessway.

It is a further object of the present invention to provide for a novel and improved portable shelter which may be folded into a compact unit for convenient transport.

It is a still further object of the present invention to provide a portable shelter or blind which is constructed of lightweight materials and may be assembled and disassembled quickly without the use of tools or separate fastener means, such as, bolts or brackets.

Yet another object of the present invention is to provide a portable blind or shelter which includes releasable connector means to effect interconnection and disengagement of panel or wall portions and frame members.

It is a further object of the present invention to provide a portable structure which can be adapted to assume different configurations for a variety of uses merely by selecting and connecting the desired number of wall portions, and which further includes a roof or cover portion which may be removably attached to the structure when a closed shelter is required.

In accordance with the present invention, there has been devised a preferred form of portable, free-standing shelter of generally frusto-conical configuration having a base and upwardly inclined sidewalls terminating in an open top. The sidewalls are defined by a plurality of panel members of generally polygonal configuration, having top and bottom edges interconnected by upwardly convergent opposite sides. Connecting means interconnect adjoining sides of the panel members in hinged-together relation so that the bottom edges of the panel members define the base of the shelter and the top edges of the panel members define the open top of the shelter. A form of the portable shelter is comprised of a plurality of generally trapezoidal frame members and generally trapezoidal panel members which span the frame members and are held in a stretched, taut condition and include means for connecting the panel members in side-by-side relation to each other so as to form a free-standing shelter structure. The panel members and frame members can be arranged so that side edges of adjacent panels are connected or overlap and surround adjacent side sections of adjacent frame members within said overlapping portion, and the panels are fastened together with the overlapping portions to retain the side sections of the frame members therein and thereby connect adjacent frame members in juxtaposed relation to one another. The overlapping portions further include integral hinge members for pivotal movement of the frame members with respect to each other and allow adjustment of the shelter into different configurations. The panel portions further include releasable fastening means along their upper and lower edges adapted to engage respective upper and lower sections of the trapezoidal frame members.

In another embodiment of the present invention, the framework member can be a pair of flexible hollow rods which are arranged diagonally across the panel and have their ends inserted in pockets formed in the corners of the panel members. The rods having the proper length, can hold the individual flexible panel members in a stretched, taut condition similar to the arrangement provided by the perimeter-type framework member previously described. The intersection point of the pair of flexible rods can be stabilized by an elastic annular member or O-ring. To make the entire unit more portable, the flexible rods can be broken down into three or four equal length sections and held in proper relationship for assembly by means of an elastic cord running through the center of the rod and allowing the unassembled sections to be articulated.

An optional removable roof or cover portion may be placed over the upper opening formed in the assembled structure which comprises a polygonal panel dimensioned to generally correspond with and close said upper opening, intersecting supporting crossbars disposed beneath the roof cover, and means for releasably securing the roof cover to the portable shelter.

The above and other objects, advantages and features of the present invention will become more readily appreciated and understood when taken together with the following detailed description of several embodiments of the present invention in conjunction with the accompanying drawings, in which:

BRIEF DESCRIPTION OF THE DRAWINGS

FIG. 6 is an isometric view of another embodiment of the portable shelter in accordance with the present invention;

FIG. 7 is a top plan view of the inside surface of the portable shelter of FIG. 6 in an expanded position, with sidewall panel portions supported by crossed-frame members;

FIG. 8 is a partially broken away isometric view of the portable shelter showing the arrangement of the support members for the side panels and roof;

FIG. 9 shows a partial view of the corner of a side panel with the pocket partially cut away;

FIG. 10 is a partial view of the sidewall receptacle for receiving the end of the roof support member; and FIG. 11 shows a fastening means for securing the edges of the sidewall panels to secure the access opening;

DETAILED DESCRIPTION OF THE PREFERRED EMBODIMENT

Figure 1:
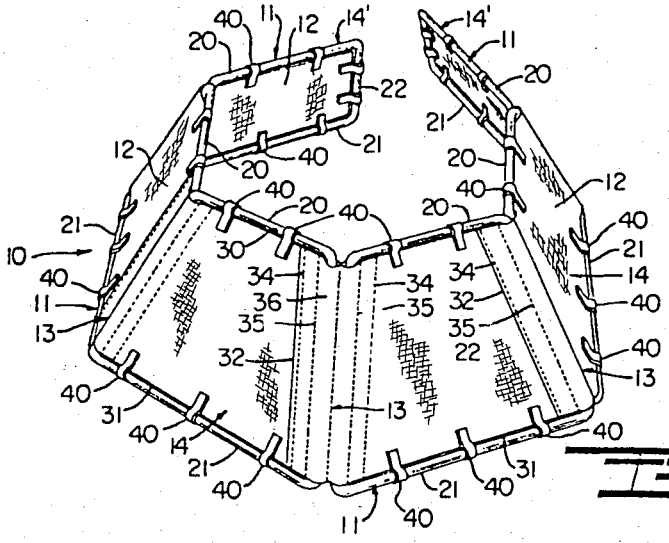
FIG. 1 is an isometric view of the portable shelter in accordance with the present invention, illustrating a substantially closed shelter wherein one sidewall is employed as an accessway.

Referring in more detail to the drawings, and particularly to FIG. 1, the portable shelter 10 is illustrated by way of example as a six-sided structure wherein a plurality of generally trapezoidal tubular frame members 11 are connected in side-by-side relation by means of a plurality of flexible fabric sheet portions or side panels 12 secured to frame members 11 and forming articulated connector portions 13 therebetween. The resulting structure of linked panels 14 may then be arranged into a closed or partially closed shelter.

The frame members 11 are symmetrically formed and preferably are trapezoidal having parallel upper and lower frame segments 20, 21 joined to non-parallel upwardly converging side segments 22 by slightly rounded corner portions 23. Each side segment 22 is disposed in fixed angled relation to an upper and a lower segment 20, 21 so as to form an obtuse angle of approximately 120° with respect to upper segment 20 and an acute angle of approximately 60° with respect to lower segment 21. It will be understood that the precise angulation may be varied depending upon the number of walls, desired height of the assembled shelter and the desired inward inclination of the walls; nonetheless, the angles formed with respect to the upper and lower frame segments 20, 21 must be supplementary, with the lower angle preferably less than 90°. Frame members 11 may also be constructed from a number of identical, generally C-shaped portions which are joined into trapezoidal configuration by uniting upper and lower free ends of each portion by means of tightly fitting sleeve connectors or the like.

Fabric sheet portions or side panels 12 are correspondingly symmetrical and therefore trapezoidal, but are somewhat shorter and wider than frame members 11 so that when a sheet 12 is superimposed upon a frame member 11, its upper and lower edges 30, 31 terminate slightly to the inside of upper and lower frame segments 20, 21 and side edges 32 extend beyond side frame segments 22. In order to connect the frame sections in articulated relation, the connector means 13 operate to secure the frame members 11 to the fabric sheets 12 in forming the panels 14 of the shelter 10, said connector means 13 preferably comprising continuations of the sheet portions which overlap and permit connection of the frame members in side-by-side relation to one another and at the same time act as hinges to permit pivotal or swinging movement of the frame member 11 with respect to each other.

Figure 2:
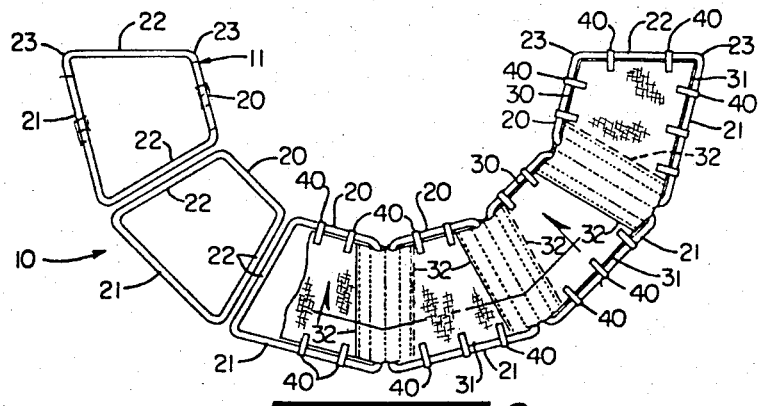
FIG. 2 is a top plan view of the portable shelter of FIG. 1 in an expanded position, with panel portions partially broken away to illustrate the frame members.
Figure 3:
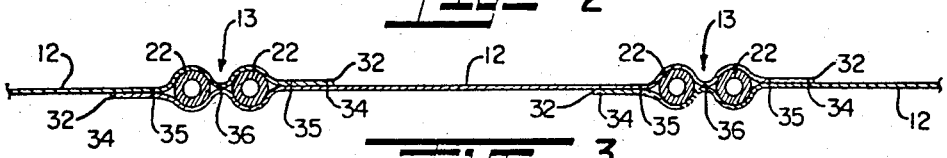
FIG. 3 is an enlarged cross-sectional view taken along lines 3—3 of FIG. 2.

Referring to FIGS. 2 and 3, one side edge 32 of a sheet 12 is positioned to extend behind one side segment 22 of a first frame member 11 and an adjacent side segment 22 of a second frame member 11, terminating slightly beyond the side segment 22 of the second frame member 11. The opposite side edge 32 is positioned to extend in front of the opposite side segment 22 of first frame member 11 and an adjacent side segment 22 of a third adjacent frame member 11. Remaining fabric sheets 12 are arranged in a like manner, so that one side edge 32 overlaps adjacent side frame segments 22 and the opposite side edge 32 underlies adjacent side frame segments 22. The sheets 12 are then stitched along side edges 32 from upper edge 30 to lower edge 31, as represented at 34. Further, stitching is employed along the inside of side frame segments 22, as at 35, and between adjacent frame members 11, as at 36. In this manner, a plurality of frame members 11 may be connected in side-by-side relation to form walls or panel members 14 as illustrated in FIG. 2.

Figure 4:
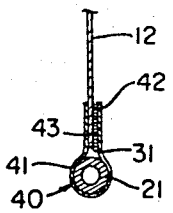
FIG. 4 is an enlarged vertical cross-sectional view of the lower portion of a shelter wall, illustrating the fastening means for securing panel portions to frame members.

It will be appreciated that the side frame segments 22 are securely retained between the overlapping connector portions 13 of the sheets 12, and that the stitching 36 between adjacent frame members 11 defines a hinge which permits a wide degree of flexing so that the angled relation between the shelter wall panels 14 may be adjusted over a considerable range. In this relation, adjoining segments 22 of terminal end panels 14' are left unconnected by folding the sheet edges 32 around the segments 22 and securing in the same manner as hereinafter described with respect to FIG. 4. It will be seen that one end panel 14' may be utilized as a door or gate to the shelter as shown, or the end panels 14' may be fastened along their adjacent abutting side frame segments 22 in order to produce a closed hexagonal shelter. Referring to FIG. 2, the structure may be spread out on the ground into a substantially flat arrangement, whereupon panels 14, 14' can be folded accordion-style at the hinge lines formed by the stitching 36 until the entire structure is folded into a compact unit for convenient carrying and storage. Naturally, many structural variations can be effected between the raised, substantially closed arrangement of FIG. 1 and the collapsed position of FIG. 2, merely by adjusting the angled relation of the walls to each other, and by removing or adding panels 14.

Upper and lower edges 30, 31 of the fabric sheets 12 are releasably fastened to upper and lower frame segments 20, 21 by appropriate means, preferably comprising hook-and-thistle type fasteners 40, commonly sold under the trademark "Velcro" ®. A lower edge fastener 40 is illustrated in detail in FIG. 4 and includes a tab portion 41, stitched at one end or otherwise secured to one side of a fabric sheet 12 and provided at the other end with a strip or patch of hook material 42. A corresponding strip of thistle material 43 is fastened in a corresponding position on the opposite side of fabric sheet 12. Tab 41 is passed under lower frame segment 21 and pulled upwardly until hook strip 42 is aligned with thistle strip 43; hook strip 42 is then pressed into engagement with thistle strip 43. Identical fasteners are employed along the free sides of the end walls and the upper edges 30 of sheets 12; however, in the latter case tab portions 41 are placed over upper frame segments 20 in order to effect engagement between hook and thistle strips 42, 43. It will be understood that other types of fastening means, such as, snaps may be applied to tabs 41 and fabric sheets 12; or further that upper and lower sheet edges 30, 31 may be provided with grommets and ties at spaced intervals.

Figure 5:
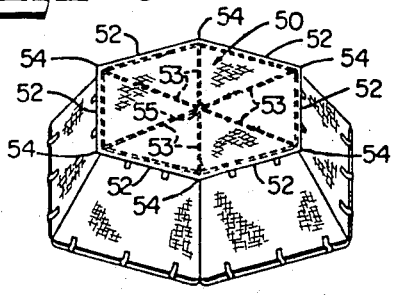
FIG. 5 is an isometric view of the portable shelter of FIG. 1 with a removable cover structure disposed thereon.
Figure 12:
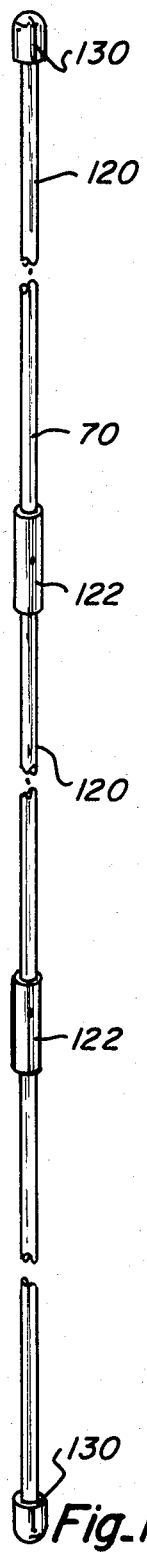
FIG. 12 is an isometric view of a flexible support rod in accordance with the present invention.
Figure 13:
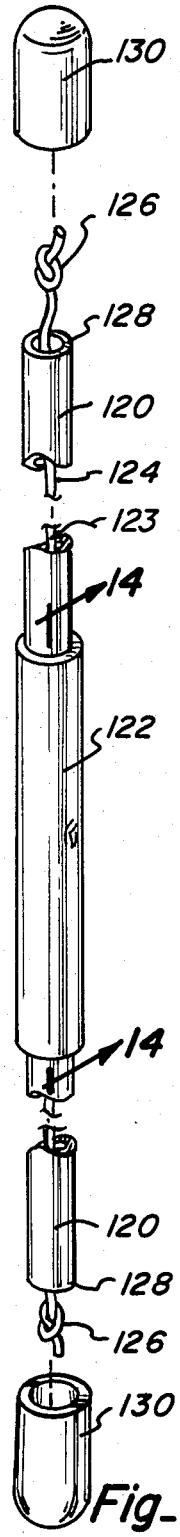
FIG. 13 is an isometric view with portions of the rod cut away to show an elastic cord mounted within the assembled rod.
Figure 15:
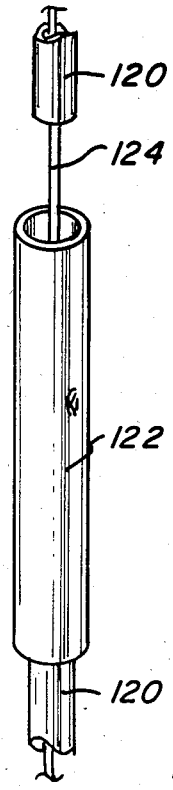
FIG. 15 is a partial pictorial view showing the ends being disassembled from the coupling.
Figure 14:
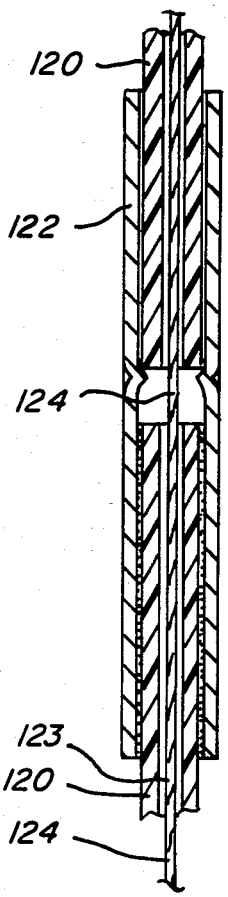
FIG. 14 is a cross sectional view of a telescoping end coupling taken along the lines 14—14 in FIG. 13.

FIG. 5 illustrates the use of the shelter 10 with an optional removable roof or cover 50, which may be particularly useful in case of bad weather, or if it should become necessary to use the structure as an emergency tent or as a shelter for firewood, food or other supplies. Roof 50 preferably comprises a polygonal fabric sheet or panel 51 having six side edges 52. Panel 51 is slightly larger in area than the upper opening of the shelter 10 formed by the assembled wall panels 14 so that side edges 52 overlap upper frame segments 20 slightly. The roof panel 51 may be fastened along the upper edges 30 of sheets 12 by Velcro closures, which may comprise a single, continuous closure providing sealing engagement around the perimeter of roof panel 51 and upper sheet edges 30. Preferably, a substantially continuous strip of thistle material is applied to the underside of the roof edges 52, and a strip of hook material is applied along the upper edges 30 of the sheets 12. The above-described Velcro fasteners 40 disposed along the upper edges 30 of fabric sheets 12 could be employed in securing the roof as well by enlarging thistle strips 43 so that a portion thereof extends below the end of the strap 41 fastened thereto. Aligned strips of hook material applied to the underside of the roof edges may then be pressed into engagement with the extended portions of the thistle strips. Alternatively, the closure means could include a plurality of hook-and-thistle fasteners applied at corners and spaced intervals therebetween. It is, of course, contemplated that the roof panel 51 may be fastened to the shelter by other suitable means, such as, by a plurality of snaps, or by grommets and ties. The removable roof structure 50 further includes underlying, intersecting crossbars 53 which extend between opposite corners 54 of the shelter 10 so as to support the roof panel 51. The crossbars 53 are held together and stabilized at their point of intersection by an elastic annular member or O-ring 55, which also serves to hold crossbars 53 together in parallel, close-fitting relation when the roof structure 50 is dismantled. Alternatively, the crossbars 53 could be positively but releasably attached to the underside of roof panel 51 by any suitable means.

Another embodiment of the free-standing shelter 60 is shown in FIG. 6. In this arrangement, the shelter is comprised of a plurality of generally trapezoidal fabric sheet portions or side panel members 62 which are joined together along hinge seams 66. An optimal top cover 64 can be arranged to completely cover and enclose the top portion of the shelter 60. A number of loops 68 are attached at the bottom of each of the hinge seams 66 so that the shelter 60 can be anchored to the ground by means of stakes or pegs to prevent the shelter from being collapsed or turned over in a high wind.

The hinge seams 66 interconnect each of the plurality of side panels 62 into a continuous semi-circular arrangement. In most cases, the hinge seams 66 will be sewn to connect the side panels together and this seam, in turn, forms a hinge area so that the panels can be folded back on each other and can allow flexibility between the side panels as shown in FIG. 6. It is also to be understood that while the hinge seam 66 is described as a seam at which the edges of the side panels overlap and are sewn together, it also could be a continuous piece of cloth from which all of the side panels have been cut. This arrangement forms a "living hinge" wherein the material itself forming the side panels also produces a foldable hinge connection.

Each side panel 62 is held in a stretched, taut condition by means of a pair of crossed support rods or poles 70. A pocket 72 formed from relatively heavy material is sewn around three outside edges 74, 76, 78 with the remaining edge facing the center of the panel being left open to receive the end of a support rod 70. Pockets 72 for each panel are positioned at each inside corner of the sidewall panel 62 and are positioned to receive the support rod 70 in a diagonally crossed arrangement. An elastic annular ring 80 such as a neoprene O-ring can be used to hold the crossed pair of support rods 70 which are necessary for each of the side panels 62.

In most cases the support rods 70 are slightly longer than the actual distance between the corresponding pockets 72. This additional length can be as much as ½" to 1½" in order to slightly bow each of the support rods 70 in order to cause the side panel material to be held in a stretched and taut condition. In this way each of the side panels is held in a rigid condition with the support rods 70 caused to bow outwardly as necessary which will add additional internal space within the closed shelter 60.

The outer edges 84, 86 of the respective end panels 88, 90 are used to close the shelter when it is erected. The edge 86 of the side panel 90 can actually be a flap portion or strip along the edge to overlie the outer edge 84 of the side panel 88. Hook-and-thistle type fastening material such as Velcro® can be respectfully sewn to the mating surfaces of the edges 84, 86 to allow the edges to be held in a releasable manner.

A strap 92 joined near its midpoint by a releasable buckle and clip 94, 96 is mounted so that one end is fastened to the upper edge 86 with the other end fastened at the inner corner at the top of the side panel 88. In this way as shown in FIG. 8 the upper continuous edge 98 formed by the side panels when erected ties the entire upper edge 98 forming a relatively rigid structure.

In order to be able to have visibility from within the shelter, openings formed by vertically positioned zippers 100 are mounted in the central upper portion of one or more of the side panels 62. Although all of the side panels can have the zippered openings, it has been found that alternating side panels has been sufficient. Where a zippered opening is provided the upper edge 98 of the side panels is supported by a strap 102 which is attached to the opposite corners of the upper edge of the side panel which includes the zipper 100. In this way, the upper edge of the side panels can be held in proper tension when the zippers 100 are lowered to provide the desired observation opening 104. Small patches of hook-and-thistle material can be sewn to the inside surfaces of the sidewall 62 and the edges of the flaps formed by the opening 104 to hold the flaps in an open position.

As shown in FIG. 8 with the shelter in the erected position the strap 92 is connected together by the fastening buckle 94, 96. This allows the side panel 88 to pivot open once the edge 84 is released from the flap 86. In this way, a user can get into and out of the shelter quite easily by merely using the side panel 88 as a hinged access door.

At the upper end of the seam hinge 66 between each of the side panels 62 is provided a grommet or small reinforced opening 106. Thus, grommets 106 are provided diagonally opposite each other across the shelter immediately below the upper edge 98 of the side panels. Roof rods or poles 110 having end caps 112 are arranged so that a small diameter protuberance on the end of the cap can be inserted into the opening provided in the grommet 106 without the entire cap passing through. Thus, a roof rod 110 is positioned so as to be mounted diagonally across the upper opening of the shelter. In the shelter illustrated in FIG. 8, three rods are provided to support the roof cover 64. The length of each of the roof rods 110 is slightly longer than required to span the distance between the grommets and thus, the rods are capable of being bowed upward above the upper edge of the side panels 62 to provide additional internal room within the shelter. A roof or top panel 116 having a polygonal shape which corresponds to the assembled upper edge of the shelter is sized to overlap the side panels, be supported by the roof rods 110 and enclose the entire upper opening of the shelter. The corners of the roof 116 are connected to the sidewall 62 at the upper end of the seam hinges 66 by means of small sections of hook-and-thistle fastening material. In this way, the roof 116 can be removed when desired but still can be secured to keep out rain, snow and wind. A tie 118 is attached to the underside of the roof 116 at its centerpoint so that the tie can be secured around the mid-point of the intersecting roof rods 110.

Figure 16:
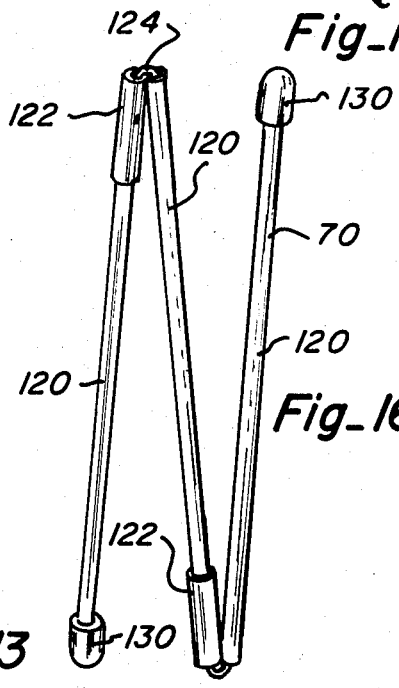
FIG. 16 is an isometric view of the flexible support rod in a disassembled condition.

It is anticipated that the support rods 70 can be of the telescoping connector type which can be broken down into a plurality of equal length sections 120 with the ends fitting together by a coupling or ferrule 122 to form a support rod or pole 70 of desired length. In addition, the individual sections 120 of the rods 70 can be interconnected by an elastic cord 124 passing through the hollow center 123 which is connected by a suitable knot 126 at the ends 128 of the rod 70 so that the individual sections will be retained in a proper sequential position to easily connect together to form the extended rod 70 when desired. Rounded end caps 130 cover the knots 126 and the ends 128 of the rods. With the rods broken down as shown in FIG. 16, the entire shelter can be disassembled and folded into a very short, compact, lightweight package which can be easily carried or stored.

The flexible support rods 110 supporting the roof cover 116 can be made similar to the rods 70 with the exception of the use of projected end caps 112. In most cases the roof rods 110 will be somewhat shorter than sidewall rods 70 because of the smaller sized top opening.

Thus, the shelter not only provides a desirable protective cover but also can be easily transported or carried to the point of use. This feature is of utmost importance in a device of this type in that the hunting location may be quite remote from highways or other transportation points.

Operation and assembly of the portable shelter has been described in the foregoing disclosure of, and the suggested variations should be obvious to one skilled in the art. Any appropriate materials may be employed in the manufacture of the shelter; however, it is desirable that the materials be lightweight, yet durable and strong, as befits the intended use of the invention by outdoorsmen. For example, frame members or support rods may be fabricated from aluminum, fiberglass or plastic tubing, and fabric sheets forming the walls and roof may be nylon, plastic, canvas, or other similar durable water-repellant material. It will be further evident that windows or double zippered openings may be formed at selected intervals in the fabric covering; also, the number, size and specific configuration of wall sections may be varied over a wide range.

It is therefore to be understood from the foregoing that various modifications and changes may be made in the construction and arrangement of parts as well as their method of fabrication without departing from the spirit and scope of the present invention as defined by the appended claims.

What is claimed is:

1. A portable, free-standing, shelter of generally frusto-conical configuration having a base and upwardly inclined sidewalls terminating in an open top, said sidewalls defined by a plurality of flexible sheet panel members, each panel member of generally polygonal configuration having top and bottom edges interconnected by upwardly convergent opposite sides; hinge means interconnecting adjoining sides of said panel members in hinged together relation; the bottom edges of said panel members defining the base of said shelter and the top edge of said panel members defining the open top of said shelter; each of said panel members being held in an extended stretched condition by a pair of crossed flexible rods which are diagonally mounted across each panel member at its opposite corners whereby each panel member is held in a self-supporting rigid configuration.

2. A portable, free-standing shelter according to claim 1, wherein each rod is formed from a plurality of separable sections which can be easily assembled in telescoping fashion into a unitary tubular elongated configuration.

3. A portable, free-standing shelter according to claim 2, wherein the separable sections of each of the rods for supporting said panel members are of equal length.

4. A portable, free-standing shelter according to claim 3, wherein the separable sections of the rod are hollow and an elastic cord is connected at the ends of the assembled rod and is arranged to pass through, support and interconnect the separable sections of the rod when they are disassembled.

5. A portable, free-standing shelter according to claim 1, which further includes a removable cover means transversing and covering the open top of said shelter.

6. A portable, free-standing shelter according to claim 5, wherein said removable cover means includes releasable fastening means releasably engageable with said top edges of said panel members for holding the removable cover means in proper position.

7. A portable, free-standing shelter according to claim 6, wherein said releasable fastening means is formed from a hook-and-thistle fastener material.

8. A portable, free-standing shelter according to claim 1, wherein the hinge means interconnecting adjoining sides of said panel members is formed from the overlapping adjacent side edges of the contiguous panel members.

9. A portable, free-standing shelter according to claim 8, wherein said overlapping side edges are sewn together the full length of each of the side edges.

10. A portable, free-standing shelter according to claim 1, wherein said hinge means interconnecting adjoining sides of said panel members is formed from continuous material forming both panel members.

11. A portable, free-standing shelter of generally frusto-conical configuration having a base with an upwardly inclined sidewall terminating in an open top, said side wall defined by a plurality of trapezoidal flexible sheet panel members, each panel member being held in a stretched, taut condition by a pair of crossed rods which are diagonally mounted across each panel member at its opposite corners, each panel member having a top edge, bottom edge and upwardly convergent side edges, hinge means interconnecting adjoining sides of said panel members whereby the panel members can be folded back across each other in accordion style, and a removable cover means sized to cover the open top of the shelter and overlap the top edge of each panel member, said top cover being supported by a plurality of flexible rods which are mounted in the top edge of said panel members and arranged diagonally across said open portion.

12. A portable, free-standing shelter as defined in claim 11, wherein said rods are formed from a plurality of separable sections which have telescoping end couplings whereby said rods can be easily disassembled allowing the shelter to be folded into a small lightweight package.

* * * * *